US005186455A

United States Patent [19]

Rosetta

[11] Patent Number: 5,186,455

[45] Date of Patent: Feb. 16, 1993

[54] PROTECTIVE COLLAR FOR GOLF TEES

[76] Inventor: James A. Rosetta, 6255 Middlebranch Rd. NE., North Canton, Ohio 44721

[21] Appl. No.: 826,458

[22] Filed: Jan. 27, 1992

[51] Int. Cl.[5] ..... A63B 55/00

[52] U.S. Cl. ..... 273/32 B

[58] Field of Search ..... 273/33 D, 202, 212, 273/325, 32 B

[56] References Cited

U.S. PATENT DOCUMENTS

| | | | |
|---|---|---|---|
| 1,803,907 | 5/1931 | Kruse | 273/202 |
| 2,011,203 | 8/1935 | Seiki | 273/33 |
| 2,440,473 | 4/1948 | Hughes | 273/206 |
| 2,993,694 | 7/1961 | Foley | 273/55 D |
| 3,516,664 | 6/1970 | Brennan | 273/33 |
| 3,606,344 | 9/1971 | Ball | 273/202 |
| 3,697,082 | 10/1972 | Di Laura | 273/205 |
| 3,749,409 | 7/1973 | Redmon | 273/33 |
| 3,782,724 | 1/1974 | Rottman | 273/55 D |
| 3,907,289 | 9/1975 | Bondu, Sr. | 273/33 |
| 4,976,431 | 12/1990 | Guenther | 273/206 |
| 5,052,689 | 10/1991 | Lettrich | 273/202 |

FOREIGN PATENT DOCUMENTS

| | | | |
|---|---|---|---|
| 481698 | 3/1938 | United Kingdom | 273/202 |

*Primary Examiner*—Theatrice Brown

*Attorney, Agent, or Firm*—Paul E. Milliken; Lee A. Germain

[57] ABSTRACT

A composite collar for surrounding a golf tee shank and protecting it from being broken or damaged by being struck by a golf club. The collar has an inner tubular cushioning member of soft cushioning material which fits on a golf tee shank and an outer tubular resilient cover of harder material than the inner mamber to withstand the initial high impact of being struck by a golf club. The outer cover member may be a bright color for high visibility.

19 Claims, 1 Drawing Sheet

PROTECTIVE COLLAR FOR GOLF TEES

This invention relates generally to protective collars for golf tees and more specifically to composite multi-layer cushioning collars which fit onto golf tee shanks to protect them from being broken or damaged by being stuck with golf clubs.

BACKGROUND OF THE INVENTION

In the past various devices have been proposed to protect both golf tees and clubs from damage when striking a golf ball on a tee and from preventing the tee from breaking off from the impact of being struck with a golf club.

One proposed solution to this problem was to provide golf tees which have flexible portions to permit them to bend when struck with the club. Typical examples of such tees are shown in U.S. Pat. No. 2,440,473 issued to J W Hughs and U.S. Pat. No. 4,976,431 issued to C Guenther.

Another device proposed for use with golf tees is shown in U.S. Pat. No. 5,052,689 issued to K P Lettrich which shows a tubular member with a flat ground engaging plate which when placed on a golf tee determines the depth the tee is inserted into the ground and therefore establishes the height of the tee head and the golf ball above the ground. This is a tee positioning device rather than a protective device.

A protective shroud for golf tees is shown in U.S. Pat. No. 3,606,344 issued to R J Ball. This device is a unitary structure of resilient material to protect the tee and golf club from damage due to impact of the club against the tee. This device is flared at each end and may be made in assorted lengths depending upon the depth on desires to insert the tee.

It has been found, however, that it is advantageous to have a golf tee protector that is durable and will withstand the high impact of being struck by a golf club. While a soft cushioning member may protect the tee for a certain number of strokes, a harder protective cover outside of a cushioning member has been found to better withstand the impact of the golf club as well as providing greater stability to the tee when inserted in the ground.

OBJECTS OF THE INVENTION

A primary object of this invention is to provide a protective collar for golf tees which is inexpensive, simple to manufacture and easy to apply to a golf tee.

Another object of the invention is to provide a protective collar for golf tees which combines the cushioning effect of a soft material with the durability of a harder resilient cover material which will better withstand the force of being struck by a golf club.

Still another object of the invention is to provide a protective collar for golf tees which may be moved to different longitudinal locations along the length of a golf tee shank depending upon the depth which the tee is to be inserted into the ground.

An even further object of the invention is to provide a protective collar for golf tees which is bright in color for high visibility for easy location.

These and other objects of the invention will become more fully apparent as the description proceeds in the following specification and the attached drawings.

SUMMARY OF THE INVENTION

This invention is a protective collar for golf tees comprising an inner tubular cushioning member of soft resilient material to absorb the shock of impact of a golf club striking the collar and reduce the transmission of force of the golf club against a golf tee positioned within the collar, the cushioning member having a hole extending axially therethrough, and being of a diameter which will receive the shank of a golf tee inserted therein in gripping relationship therewith, and an outer tubular cover member surrounding the cushioning member in intimate contact therewith, said cover member being constructed of resilient material which is harder than the material of the cushioning member to withstand the initial high impact of a golf club striking the outside of the collar.

DESCRIPTION OF THE PREFERRED EMBODIMENTS

Figure 1:
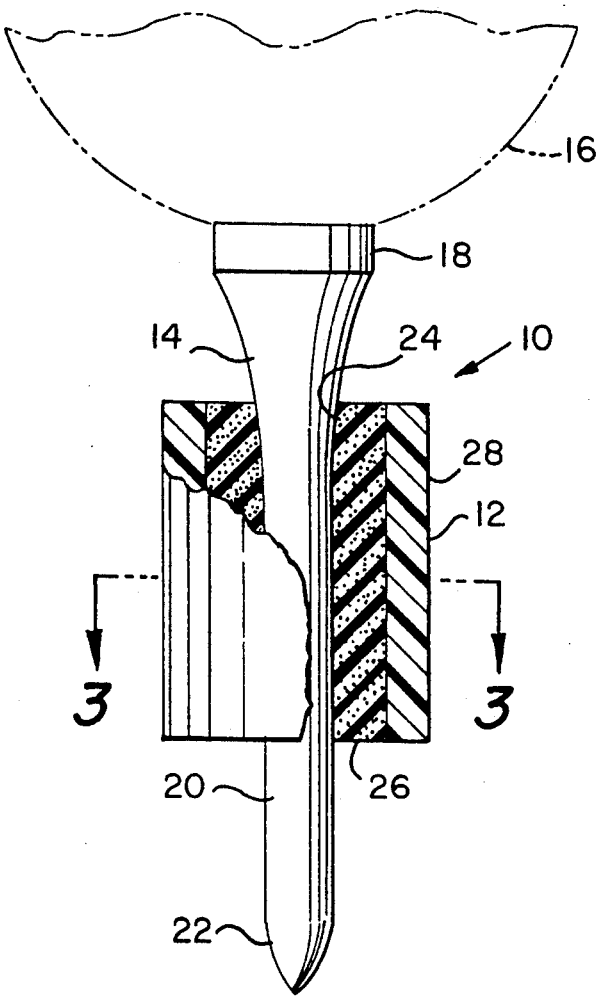
FIG. 1 is an elevational view partly in vertical section showing the protective collar of the invention positioned in its operative position on the shank of a conventional golf tee on which a golf ball is supported.

Referring now to the drawings and particular to FIG. 1, the numeral 10 indicates generally an assembly combining a collar 12 positioned on a conventional golf tee 14 supporting a golf ball 16. As described in U.S. Pat. No. 4,190,955, the shank diameter of standard golf tees may vary from 0.150" (3.81 mm) to 0.200" (5.08 mm).

The golf tee 14 has a head 18 tapering into a shank 20 with a pointed end 22 for insertion into the ground. The shank 20 extends through an axially extending center hole 24 in a soft resilient inner cushioning member 26 of the collar 12. The cushioning member or inertia ring 26 is made preferably of foam rubber or other soft material which has the appropriate cushioning properties to absorb the shock of impact of a golf tee striking the collar 12 and reduce the transmission of the shock to the golf tee 14 which is surrounded by the cushioning member. Surrounding the cushioning member 26 is a tubular outer cover member 28 which is made of a resilient but harder high impact resistant material such as polyurethane or other material having sufficient impact resistant properties.

The outer periphery of the cushioning member 26 is normally in intimate contact with the inner periphery of the outer cover member 28 and may be attached thereto by adhesive or other suitable means. The hole 24 through the cushioning member 26 may be of a slightly smaller inside diameter than the outside diameter of the shank 20 so that when the collar 12 is slid onto the golf tee 14 there is a snug fit which causes the member 26 to grip the shank 20 and hold the collar 12 in whatever longitudinal position it is moved to on the shank 20. When the hole 24 is smaller than the outside diameter of the tee shank 20, insertion of the shank 20 in the hole 24 puts the wall of the cushioning member 26 under compression between the shank 20 and the outer cover member 28. This compression helps to retain the collar 12 in a designated longitudinal position on the tee 14. The collar 12 can be positioned in the location shown in FIG. 1 or it can be higher or lower on the tee depending upon how deep into the ground the tee 14 is to be inserted.

The collar can also be made in various lengths or cut into various lengths to adjust to the depth of insertion of the tee 16 into the ground.

Figure 2:
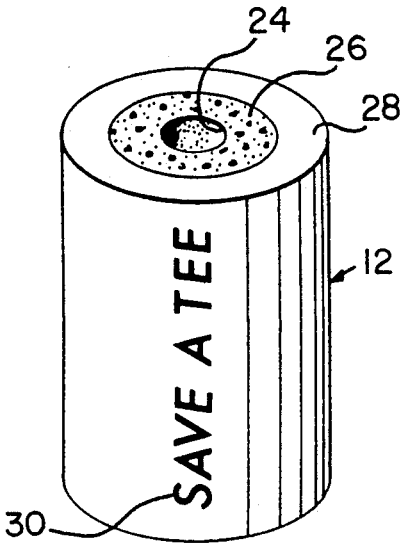
FIG. 2 is a perspective view of the protective collar of the invention.
Figure 3:
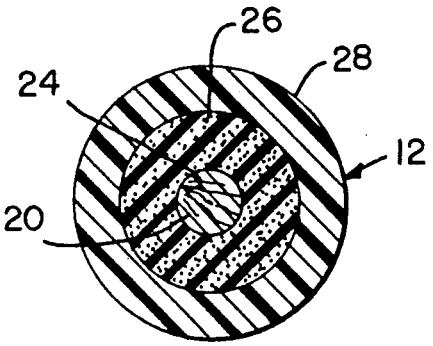
FIG. 3 is a cross sectional view taken on line 3—3 of FIG. 1.

The outer cover member 28 can be made in bright colors to make the collars 12 more attractive and more visible for locating them after they have been struck with a golf club. The outer cover member 28 can also be printed with induce 30 (shown in FIG. 2) for advertising or personalization of the collar 12.

In addition to protecting the tee 14 and the golf club (not shown) from damage, the extra weight of the collar prevents the collar and tee from traveling as far as a tee without a collar when struck with a club and makes it easier to locate the tee.

In operation, when a club strikes the outer cover 28 of the collar 12, the physical properties and the wall thickness of the cover 28 enables it to withstand the force of the impact without breaking or tearing apart. The cover 28 absorbs part of the initial impact and transmits the rest to the soft inner cushioning member 26 which absorbs an additional amount of the impact and further reduces the force of the impact before it reaches the tee 14. The golf club in turn, is protected from damage from hitting the tee 14 since it instead his the resilient outer cover 28 which will not damage the club.

As shown in the drawings the walls of the inner cushioning member 26 and the outer cover member are preferably made of substantially uniform thickness throughout their length as a matter of manufacturing convenience. This thickness can be varied, however, however without departing from the scope of the invention.

These and various other modifications can be made herein without departing from the scope of the invention.

I claim:

1. A protective collar for golf tees to absorb the shock of impact of a golf club striking the collar and reduce the transmission of force of the golf club against a golf tee positioned within the collar comprising:

(A) an inner tubular cushioning member of soft resilient material;

(B) the cushioning member having a golf tee shank receiving hole extending axially therethrough, said hole being of a smaller diameter than the outside diameter of 0.150 inches (3.18 mm) of a standard golf tee shank when said collar is not positioned on a golf tee; and (C) a circumferentially continuous outer tubular cover member surrounding the cushioning member in intimate contact therewith;

(D) said cover member being constructed of resilient material which is harder than the material of the cushioning member to withstand the initial high impact of a golf club striking the outside of the collar.

2. The protective collar as claimed in claim 1 wherein the inner tubular cushioning member is comprised of an elastomeric foam material.

3. The protective collar as claimed in claim 2 wherein the foam material is rubber.

4. The protective collar as claimed in claim 1 wherein the cushioning member is put under compression when used for its intended purpose.

5. The protective collar as claimed in claim 1 wherein the collar is of uniform cross section throughout its length.

6. The protective collar as claimed in claim 1 wherein the outer cover member is polyurethane.

7. The protective collar as claimed in claim 1 wherein the outer cover member is of a bright color which will contrast to golf greens and other colors in the outdoor environment to make it easier to locate the collar and the golf tee therein.

8. The protective collar as claimed in claim 1 wherein the outer cover is imprinted with decorative indicia for personalization, decoration or advertising.

9. The protective collar as claimed in claim 1 wherein the inner cushioning member and the outer cover member are adhered to each other.

10. In combination, a golf tee having a head and a shank, and a protective collar surrounding the shank comprising:

(A) an inner tubular cushioning member of soft resilient material to absorb the shock of impact of a golf club striking the collar and reduce the transmission of force of the golf club against the golf tee positioned within the collar;

(B) the cushioning member having a hole extending axially therethrough, and being of a diameter which will receive the shank of the golf tee inserted therein; and (C) a circumferentially continuous outer tubular cover member surrounding the cushioning member;

(D) said cover member being constructed of resilient material which is harder than the material of the cushioning member to withstand the initial high impact of a golf club striking the outside of the collar.

11. The combination as claimed in claim 10 wherein the inner tubular cushioning member is comprised of an elastomeric foam material.

12. The combination as claimed in claim 11 wherein the foam material is rubber.

13. The combination as claimed in claim 10 wherein the hole extending axially through the cushioning member is of a smaller diameter than the outside diameter of the shank of the golf tee when the collar is not positioned on the golf tee and wherein the hole is expanded by the insertion of the golf tee so that the cushioning member firmly grips the shank of the golf tee inserted therein.

14. The combination as claimed in claim 13 wherein the cushioning member is put under compression between the outer cover and the shank of the golf tee inserted therein.

15. The combination as claimed in claim 10 wherein the collar is of uniform cross section throughout its length.

16. The combination as claimed in claim 10 wherein the outer cover member is polyurethane.

17. The combination as claimed in claim 10 wherein the outer cover member is of a bright color which will contrast to golf greens and other colors in the outdoor environment to make it easier to locate the collar and the golf tee therein.

18. The combination as claimed in claim 10 wherein the outer cover is imprinted with decorative indicia for personalization, decoration or advertising.

19. The combination as claimed in claim 10 wherein the inner cushioning member and the outer cover member are adhered to each other.

* * * * *